United States Patent [19]

Newcomb et al.

[11] 3,984,916

[45] Oct. 12, 1976

[54] WEAPON SIGHT

[75] Inventors: Fred N. Newcomb, Kingsville; Dominick J. Giordano, Forest Hill, both of Md.

[73] Assignee: The United States of America as represented by the Secretary of the Army, Washington, D.C.

[22] Filed: Oct. 6, 1975

[21] Appl. No.: 619,714

[52] U.S. Cl. ..... 33/251; 33/254

[51] Int. Cl.[2] ..... F41G 1/16

[58] Field of Search ..... 33/251, 252, 253, 254, 33/255, 256, 258, 259

[56] References Cited

UNITED STATES PATENTS

| | | | |
|---|---|---|---|
| 45,333 | 12/1864 | Miles | 33/254 |
| 1,082,355 | 12/1913 | Nash | 33/254 |

FOREIGN PATENTS OR APPLICATIONS

| | | | |
|---|---|---|---|
| 588,646 | 5/1947 | United Kingdom | 33/251 |

*Primary Examiner*—William D. Martin, Jr.

*Attorney, Agent, or Firm*—Nathan Edelberg; Robert P. Gibson; Saul Elbaum

[57] ABSTRACT

A weapon sight having a peep sight mounted to a flexible, curved transverse cross-section bar movable across a curved surface interior to a housing. The flexible bar, which is preset and locked at a fixed range, is stored horizontally below the cover of the housing and assumes a vertical position with the peep sight at the fixed range when the cover is opened. A protuberance from the other end of the bar produces an audible and tactile indication of fixed variations in range. The range adjustment knob drives the bar with a single pin.

8 Claims, 4 Drawing Figures

WEAPON SIGHT

The invention described herein may be manufactured, used, and licensed by or for the U.S. Government for governmental purposes without the payment to me of any royalty thereon.

BACKGROUND OF THE INVENTION

1. Field of the Invention

The present invention relates generally to weapon sights and more specifically to a flexible weapon sight which springs up to a preset position from a stored position.

2. Description of the Prior Art

Weapon sights of the prior art have been made generally of durable, metal materials for multiple use in a wide range of diverse environments. The relationship between the range adjusting knob and the elevated sighting element has involved gear and friction drives. With the advent of single use weapons, it has become imperative to have inexpensive sights which (when deployed) will assume a preset battle range condition for immediate firing as well as having the ability to be quickly adjusted to other ranges if they are known.

A mechanically simple sight is illustrated in U.S. Pat. No. 45,333 as a spring B which is manually pushed along the horizontal plane to adjust the vertical displacement of a sight notch F. Since this patent does not disclose a housing, the presetting of this specific sight to a preset battle sight would have the sight notch F always in an elevated position above the barrel. This is a major problem since the sight would be exposed to damage during carrying and storing. It cannot be stressed enough how important it is to have a sight which is automatically deployed to a specific range so as to be immediately available for instantaneous aiming and firing. Similarly, the user of the weapon to which the sight of U.S. Pat. No. 45,333 is attached would have to be looking down on the top of the barrel in order to note the specific range adjustments at H. This also slows down the ability of the user to fire the weapon.

Though other sights of the prior art have included housings, these housings and the sights encompassed therein have not been inexpensively manufactured. Thus, there exists a need for an inexpensive sight for a throw-away or onetime use weapon which is automatically deployed to a fixed battle site range.

SUMMARY OF THE INVENTION

The present invention provides an economical and inexpensive battle sight using a resilient sight bar which is stored in a generally horizontal position below the cover of the housing and automatically springs up to a vertical preset battle range position upon opening or removing the cover. The bar is a single piece of thin metal having a curved transverse cross-section so as to provide rigidity to the light metal bar. A day-night peep is pivotally connected to the top end of the sight bar and the opposite end has a protuberance attached which coacts with the base of the housing to produce audible and tactile indications of specific changes of range. The range adjust knob is attached to the sight bar by a single pin to provide an inexpensive and secure drive between the range adjust knob and the sight bar. A central recess is provided in an interior curved surface of the housing so that the pin rides in the recess during adjustment of the elevation of the sight by the range adjustment knob. A flat is provided on the range adjustment knob to coact with the cover to lock and guarantee the preset battle site range by permitting the cover to close only when the range adjustment knob is at the preset battle site range.

OBJECTS OF THE INVENTION

It is an object of the present invention to provide an inexpensive, retractable preset sight for a one-time or disposable weapon.

A further object of the present invention is to provide a resilient sight mechanism which automatically springs to a preset battle site position upon removing the top of the sight casing.

An even further object of the present invention is to provide an inexpensive sight which provides an audible and tactile indication of change of range setting from a preset battle range position.

A still further object of the present invention is a sight having a day-night peep sight where the detent is merely coincidental curved surfaces.

A still further object is to provide a simple mechanism to guarantee the preset battle site range in the stored position.

Other objects, advantages and novel features of the present invention will become apparent from a detailed description of the accompanying drawings.

DESCRIPTION OF THE PREFERRED EMBODIMENTS

Figure 2:
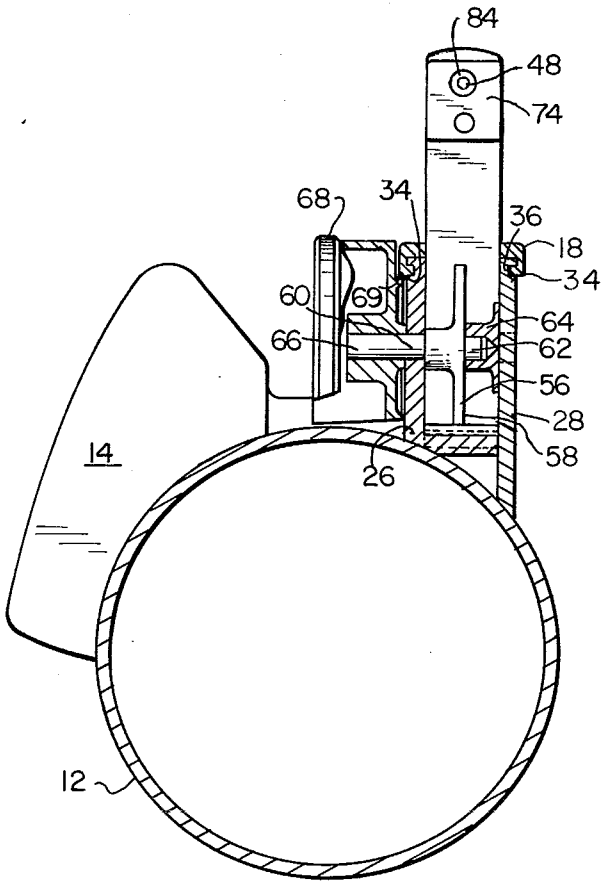
FIG. 2 is a front cross-sectional elevation taken along lines 2—2 of FIG. 1.
Figure 1:
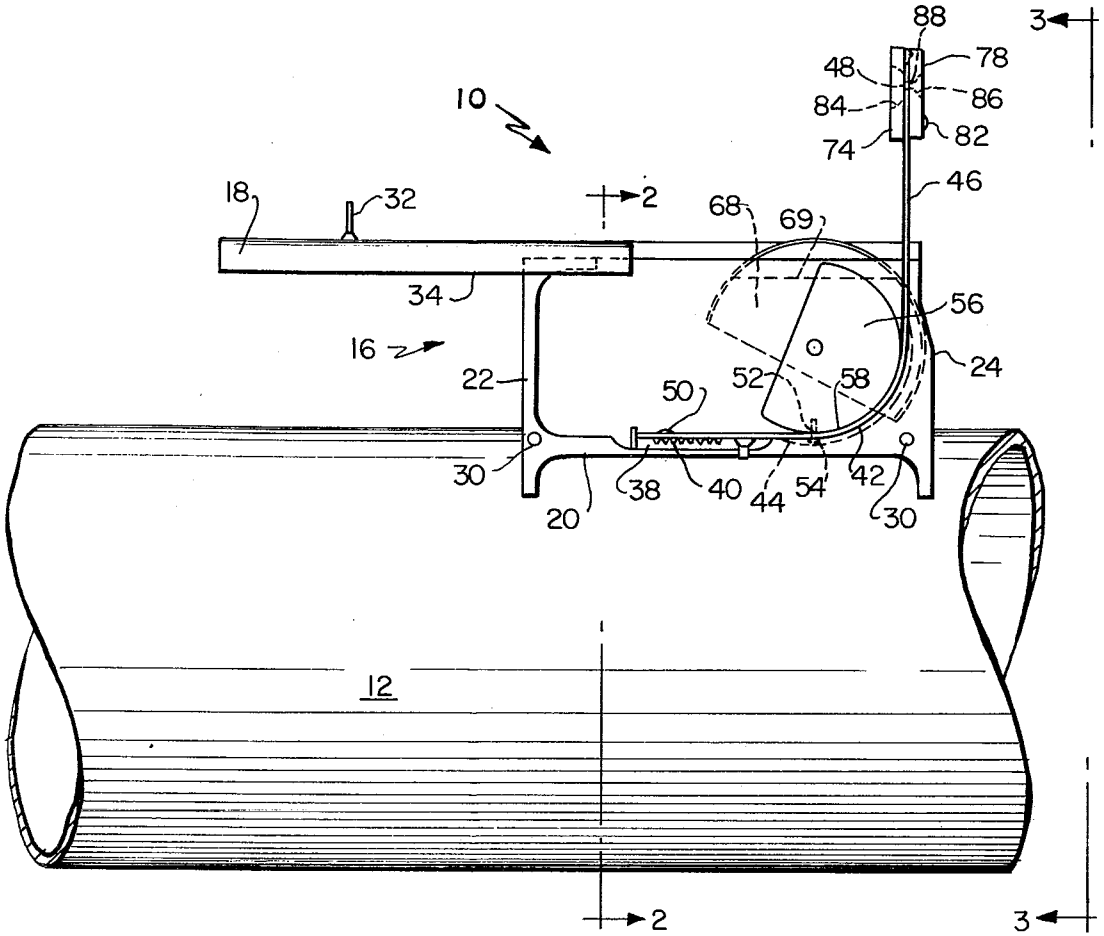
FIG. 1 is a side elevation of a preferred embodiment of the weapon sight of the present invention with the side plate of the housing removed.
Figure 4:
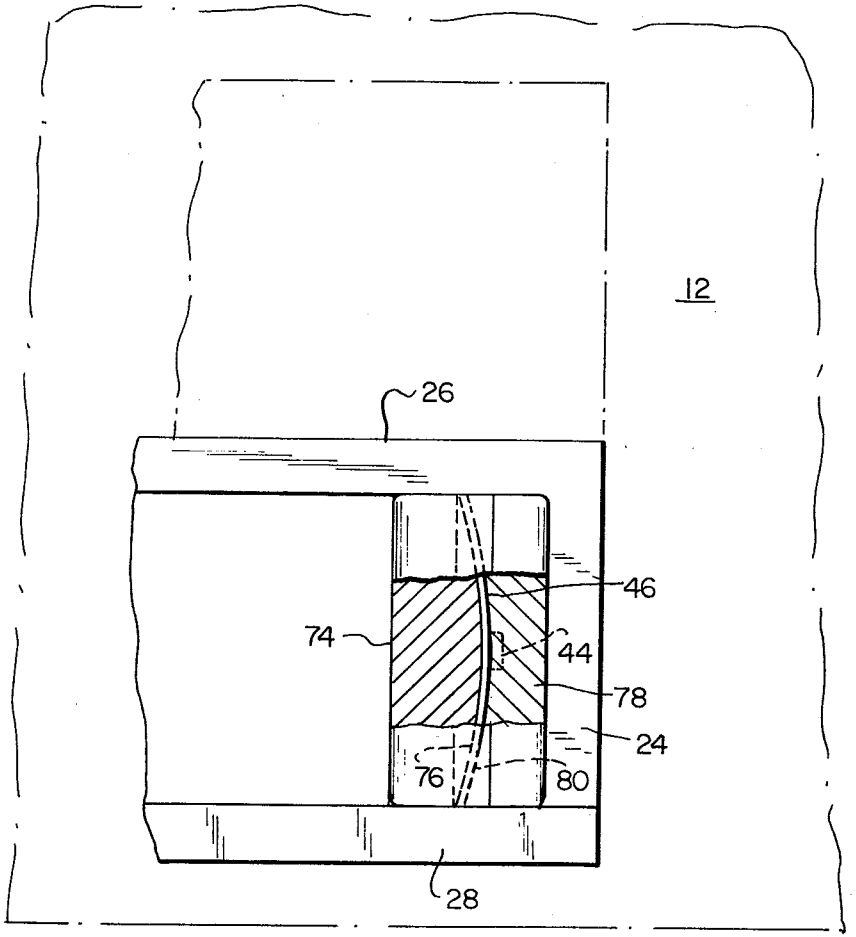
FIG. 4 is a top partial elevation illustrating the detail of the peep sight.

A preferred embodiment of the weapon sight of the present invention is illustrated in FIGS. 1–4. The sight 10 is mounted to the cylindrical exterior of a disposable weapon 12 having a trigger mechanism 14. Though the weapon 12 is being illustrated as a disposable rocket launcher, it should be noted that the present sight may be mounted on a disposable weapon or any re-usable weapon which requires an inexpensive sight. The sight housing 16 has a slidable cover 18, a bottom 20, front and rear walls 22 and 24, and side walls 26 and 28. The bottom 20 and lateral walls 22, 24 and 26 may be made of a single piece of material such as metal or plastic. The side wall 28 is a single plate of the same material and is attached by fasteners received in holes 30 illustrated in FIG. 1. By providing wall 28 as a separate plate, the sight may be assembled and mounted within the interior of the housing very economically.

The top or cover 18 has a member 32 extending up and away from the plate of cover 18 to provide means by which the cover 18 may be readily moved in the horizontal plane. L-shaped members 34 extend down from cover 18 and ride within recesses or tracts 36 in walls 26 and 28 of the housing. By movably mounting the cover 18 around the exterior of the side walls so as to lie in recesses 36, the cover prevents dust and mud from entering the casing and interfering with the operation of the sight during transporting on the battlefield.

As to be explained more fully below, the left (as viewed in FIG. 2) L-shaped member 34 coacts with the range adjustment knob to lock and guarantee that the range adjustment knob is set at the preset battle site range. Although top 18 is shown as mounted exterior to the remainder of the housing, it is evident that the top 18 may be mounted between the walls 26 and 28. The internal mount of cover 18 is not considered as advantageous as exterior mounting of the cover.

In the bottom 20 of the housing is mounted a plate 38 having a plurality of serrated edges 40 extending up therefrom. As will be explained later, the serrated edges 40 are separated by a specific distance which is proportional to a preselected range change which may be, for example, 50 yards of range between serrated edges.

Starting at the bottom and near the rear of bottom 20 and extending up the rear wall 24 of the housing is a surface 42 which is curved around the length and width of the housing. Thus, the transverse cross-section of the curved surface 42 is concave relative to the interior of the housing. A recess 44 is centered and runs substantially the length of curved surface 42 to carry a pin which will be explained hereafter.

The sight includes a sight bar 46 of spring stock metal having a sight aperture 48 in an extended end and a protuberance 50 mounted to the other end. The protuberance 50 extends down to, and coacts with, the serrated edges 40 so as to provide an audible and tactile indication of specific range changes as the sight bar 46 is moved along the curved surface 42. An aperture 52 provided in sight bar 46 receives a pin 54 which connects the sight bar 46 to an internal curved member 56 of the range adjustment means. Pin 54 rides in recess 44 in the curved surface. As will be explained later, the pin provides the single positive connection of the sight bar 46 to the range adjustment means which includes internal curved member 56 and an external range adjustment knob 68. As seen specifically in FIG. 4, the sight bar 46 has a curved transverse cross-section. This curvature of the thin spring metal stock provides rigidity to the extended portion of bar 46 so as to not be effected by wind or other environmental conditions during sighting operations.

Figure 3:
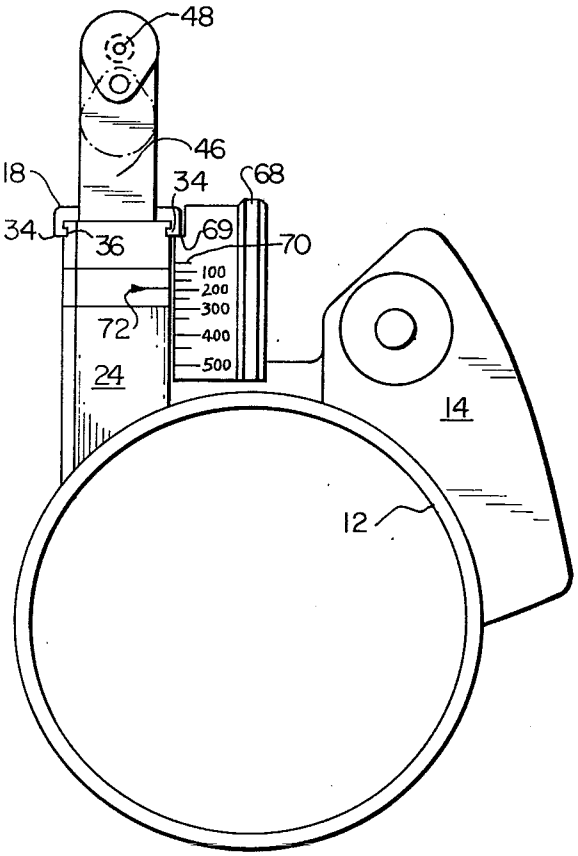
FIG. 3 is a rear elevation taken along lines 3—3 of FIG. 1.

Member 56 has a curved surface portion 58 to which pin 54 is connected. The curved surface 58 and the interior curved surface 42 of the housing have substantially the same curvature. Sight bar 46 rides between the two curved surfaces 58 and 42. A rod portion 60 of member 56 has a first end 62 received in a bushing or journel 64 attached to the side wall plate 28 of the housing. The second end of 60 is received in the range adjustment knob 68 which lies exterior and adjacent to wall 26 of the housing. A flat or planar surface 69 is provided on the range adjustment knob 68 adjacent housing wall 26 and L-shaped member 34 of cover 18. The flat surface 69 coacts with L-shaped member 34 to permit the closing of the cover 18 only when the flat surface is parallel to the cover. At this position, the range adjustment knob 68 is set to the battle site range. Thus, the sight is locked at, and guaranteed to be set at, the battle site range. The range adjustment knob 68 may have flat surface 69 machined to correspond to any desired battle site range. As shown in FIG. 3, indicia 70 are placed on range adjustment knob 68 to move relative to a fiducial mark 72 on the rear wall 24 of the housing.

The peep sight of the present invention includes a front plate 74 having a curved surface 76 and a rear plate 78 having a curved surface 80. The sight bar 46 lies between the two curved surfaces 76 and 80. The front sight plate 74 and the rear sight plate 78 are joined to the bar 46 by a pin 82. The front plate 74 has a tapered aperture 84 therein which is larger than the sight aperture 48 in the bar 46. The rear plate 78 has a tapered aperture 86 terminating in a counter-bore aperature 88. The aperture 88 is smaller than the aperture 48 in bar 46. Aperture 88, which may be approximately 2 millimeters in diameter, comprises the daylight peep sight in the position shown in FIGS. 1–4. By rotating rear plate 78 180°, so as to lie in the phantom view as shwon in FIG. 3, the aperture 48 (which may be approximately 6 millimeters in diameter) comprises the nightlight peep sight. Since bar 46 has a curved transverse cross-section, the rear sight plate 78 may be rotated and locked in two positions 180° apart by using merely the relationship of the curvature of bar 46 and of surface 80 of rear sight plate 78. Thus, a detent is provided without any other mechanical elements.

The sight of the present invention is installed at the factory on a disposable weapon 12. The elevation of the sight bar 46 is adjusted so as to assume a battle site elevation by rotation of range adjustment knob 68 until flat surface 69 is parallel to the cover 18. Sight bar 46 is rotated from its extended vertical position to a horizontal position around curved surface 58 of element 56. The cover 18 is slid back over so as to close the top of the housing, lock the range adjustment knob at the battle site range, and retain the extended portion of sight bar 46 in a generally horizontal position. If, for example, the disposable element is a rocker launcher, end caps are placed over the two ends of the rocket launching cylinder 12 and a front sight, separate from the present sight element 10, is also collapsed into a stored position. As noted before, the cover 18 (by extending over the top and around the lateral edges of the housing) provides a dust and mud-free cover. The weapon sight of the present invention as stored may be carried into battlefield conditions.

When it is desired to put the present weapon sight into use, the end caps are taken off the weapon, the front sight is spring-loaded so that the apparatus is automatically operated, and the operator (by pushing on extended element 32) slides the cover 18 forward and sight bar 46, due to its resiliency, springs up into a vertical extended position at a battlefield range height. The operator may then immediately aim through the peep sight and fire. If it is night conditions, the operator merely rotates rear sight element 180° to provide a night sight peep. In either day or night conditions, the operator (if he has time and knowledge of the specific range of the target), may rotate range adjustment knob 68, which has been unlocked by opening cover 18, to change the elevation of sight bar 46 for the specific range. Without wasting time to visually check the specific range, the operator may determine by the number of clicks the change of range from the preset battlefield range and may fire immediately upon hearing or feeling the required number of clicks. This is especially advantageous in dark surroundings.

Thus, it is seen that the objects of the present invention are achieved by the preferred embodiments to provide an inexpensive weapon sight which automatically deploys itself to a fixed battlefield range and provides audible and tactile indication of given changes of range. The simplicity of design reduces the cost of raw materials to make the sight as well as providing a reliable sight. Though the present invention has been described in detail, it is obvious that changes may be made without altering the scope of the invention. I wish it to be understood that I do not desire to be limited to the exact details of the construction shown and described for obvious modifications can be made by a person skilled in the art.

What is claimed is:

1. A weapon sight comprising:

a housing have at least two lateral parallel walls and a cover slidably mounted to the top edge of said lateral walls;

a curved surface within said housing;

a flexible bar positioned on said curved surface and extending from said housing, said bar having a curved transverse cross-section;

a sight means on the extended end of said bar; and range adjustment means having a portion exterior to said housing, an interior portion connected to said bar for moving said bar along said curved surface to vary the elevation of said extended end of said bar, and a flat surface;

wherein said cover includes a means coacting with said flat surface to lock said range adjustment means at a preselected range setting when said cover is substantially closed.

2. The weapon sight of claim 1 wherein said interior portion of said range adjustment means has a curved periphery of substantially the same curvature as said curved surface, said bar has a first aperture and a pin connects said interior portion of said range adjustment means to said bar through said aperture.

3. The weapon of claim 2 wherein said curved surface includes a central recess and a portion of said pin rides in said recess.

4. The weapon of claim 1 wherein the non-extended end of said bar includes a protuberance extending substantially perpendicular from said bar, a plurality of serrated edges in said housing adjacent said protuberance, said protuberance produces an audible signal as it moves over said edges.

5. The weapon of claim 4 wherein said serrated edges are separated at a distance to correspond to specific amounts of range variation whereby variation of range setting is both audibly and tactually determinable.

6. A weapon of claim 1 wherein said sight means includes a second aperture in the extended end of said bar, a plate pivotally mounted to said bar, said plate has an orifice of a smaller diameter than said second aperture and is aligned with said second aperture in a first position.

7. The weapon of claim 6 wherein said plate has a curved face adjacent to said curved transverse cross-section of said bar, said plate is maintained in said first position by the coincidence of said curved face and said curved transverse cross-section of said bar.

8. The weapon of claim 1 wherein the extended portion of said bar is of sufficient length and flexibility to be in a horizontal position below said cover when said cover is closed and to assume a vertical extended position corresponding to a preselected range when said cover is opened.

* * * * *